US007044683B2

(12) United States Patent
Berg

(10) Patent No.: US 7,044,683 B2
(45) Date of Patent: May 16, 2006

(54) STRIPPING DEVICE FOR A SOIL COMPACTING ROLLER AND A SOIL COMPACTING ROLLER HAVING SUCH A STRIPPING DEVICE

(75) Inventor: Christian Berg, Volkenroth (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 10/954,480

(22) Filed: Oct. 1, 2004

(65) Prior Publication Data

US 2005/0117971 A1 Jun. 2, 2005

(30) Foreign Application Priority Data

Oct. 2, 2003 (DE) ..... 103 45 973
Sep. 6, 2004 (DE) ..... 10 2004 043 038

(51) Int. Cl.
*E01C 19/43* (2006.01)

(52) U.S. Cl. ..... 404/129; 172/606

(58) Field of Classification Search ..... 404/120, 404/129, 121; 172/606
See application file for complete search history.

(56) References Cited

U.S. PATENT DOCUMENTS

| | | | | |
|---|---|---|---|---|
| 258,046 | A * | 5/1882 | Fogarty | 172/103 |
| 484,841 | A * | 10/1892 | Aveling | 280/855 |
| 702,868 | A * | 6/1902 | Clucas | 404/129 |
| 1,065,188 | A | 6/1913 | Thompson | |
| 1,190,257 | A * | 7/1916 | Henderson | 404/126 |
| 1,933,679 | A * | 11/1933 | Nicewander et al. | 280/855 |
| 2,108,291 | A * | 2/1938 | Roy | 280/855 |
| 3,085,484 | A * | 4/1963 | McAdams et al. | 404/121 |
| 3,675,546 | A * | 7/1972 | Smith | 404/129 |
| 3,802,339 | A * | 4/1974 | Andersson et al. | 100/174 |
| 3,922,106 | A | 11/1975 | Caron et al. | 404/121 |
| 4,040,762 | A * | 8/1977 | Nilsson | 404/129 |
| 4,348,134 | A * | 9/1982 | Goehler | 404/129 |
| 5,222,828 | A * | 6/1993 | Magalski | 404/103 |
| 5,988,940 | A * | 11/1999 | Johansson | 404/129 |

FOREIGN PATENT DOCUMENTS

| | | |
|---|---|---|
| DE | 239009 | 10/1911 |
| DE | 19 47 317 | 9/1969 |
| DE | 87 09 075 | 7/1987 |
| DE | 92 14 279 | 10/1992 |
| DE | 94 18 069 | 11/1994 |
| DE | 195 39 542 | 10/1995 |

* cited by examiner

*Primary Examiner*—Raymond Addie
(74) *Attorney, Agent, or Firm*—Baker & Hostetler LLP

(57) ABSTRACT

A stripping device for a soil compacting roller having tamping feet is equipped with a spar on which are provided stripper teeth and an optionally adjustable spar mount which permits readjustment of the stripper teeth on the soil compacting roller. The spar preferably comprises a pipe having a circular cross section and a spar mount and on at least one end having a pair of half shells which surround the pipe and are detachably connected for clamping the pipe in a rotationally fixed and displacement-fixed manner. This permits readjustment of the stripper teeth by a swiveling movement of the spar, which results in a large gap width for removing stripped-off soil material in a small area on which soil material can be deposited.

15 Claims, 2 Drawing Sheets

STRIPPING DEVICE FOR A SOIL COMPACTING ROLLER AND A SOIL COMPACTING ROLLER HAVING SUCH A STRIPPING DEVICE

FIELD OF THE INVENTION

This invention relates to a stripping device for a soil compacting roller having tamping feet, having a spar on which are arranged stripper teeth and having an optionally adjustable spar mount which permits readjustment of the stripper teeth on the soil compacting roller. This invention also relates to a soil compacting roller having such a stripping device.

BACKGROUND OF THE INVENTION

In the case of soil compacting rollers having tamping feet, the problem occurs that soil material adheres to the binding wire between the tamping feet, thus having a negative effect on the efficiency of the soil compacting roller. It is known that individual stripper teeth made of flat steel or steel castings may be mounted individually on the crossbar, protruding into the interspaces between the tamping feet. It can be regarded as a disadvantage here that soil material may clog the gaps between the crossbar and the binding wire. In unfavorable cases, soil material may even become built up over the crossbar and the binding wire. In any case, an interruption in work is necessary for cleaning.

Furthermore, it is known that flat steel teeth may be mounted on a spar beneath the crossbar, where the crossbar, the spar and the roller axle are all parallel. The flat steel bars are held between two rails in such a manner that they can be adjusted individually when they shows signs of wear. To do so, first the clamp holding the two rails must be released and then each individual tooth or the entire rail may be adjusted. Therefore, this process is very time consuming and labor intensive. Furthermore, a certain distance, which is determined by the system, must be maintained between the mount and the binding wire; this in turns results in a reduction in the gap between the crossbar and the binding wire and leads to larger areas on the strippers where soil may be deposited. Although good cleaning of the binding wire is achieved as a rule, under certain soil conditions, the stripped-off material may not fall through without a problem.

SUMMARY OF THE INVENTION

On the other hand, the overall length of a soil compacting roller cannot be increased indefinitely to widen the gap.

The object of this invention is to provide a stripping device and a soil compacting roller of the type defined in the preamble in which there is a sufficiently large gap from the binding wire without having to enlarge the deposition area and the overall length.

This object is achieved by the fact that the spar has a pipe and the spar mount has a pair of detachably connected half shells at least partially surrounding the pipe on at least one end for rotationally fixed and undisplaceable clamping of the pipe.

A basic idea of the invention is thus that readjustment of the stripper teeth can be performed by a pivoting movement of the spar. The rotational movement results in a long adjustment path, so that the stripper teeth are able to be worn down to a great extent without impairing the stripping effect on the whole. Thus, a very long service lifetime can be achieved. The distance between the spar and the binding wire is independent of the adjustment distance in the swivel readjustment and can therefore be minimized. Furthermore, the distance between the spar and the crossbar can be kept as great as possible, regardless of the adjustment distance. The mounting of the stripper teeth permits a relatively small diameter, which has the advantage that the area on which soil material can collect is relatively small. This also prevents clogging of the gap between the crossbar and the batch, even in the case of sticky material.

Preferred refinements of this invention are described in the dependent claims.

It especially expedient that the spar is a pipe having a round, circular or elliptical cross section. Angular cross sections, e.g., triangular, quadrangular or polygonal, may also be used because they can be held well in a rotationally fixed manner because of the corners. The spar, however, preferably has a pipe with a circular cross section because this is especially stable and resistant to torsion.

Furthermore, it is also especially advantageous that the support areas of the stripper teeth have two fingers which extend around the spar in the area of a circular segment, these fingers being welded to the pipe. The round cross section facilitates soil falling through and also permits easy cleaning as needed.

Despite the small cross section of the spar, the fingers extending around it permit a stable mounting of the stripper teeth.

Welding deformation of the pipe in welding the stripper teeth onto it is prevented by the fact that the fingers are welded to the pipe at symmetrical offset angles, preferably diametrically opposed at 180° to one another on the pipe.

A means of mounting the pipe that is particularly easy to establish and simple to handle consists of the fact that a pair of half shells for detachable rotationally fixed and non-displaceable clamping of the pipe are provided on each end of the pipe. Standard components may be used for this purpose. With such a clamping device it is not only possible to perform the readjustment of the stripper teeth by pivoting it easily but also an adjustment and equalization of tolerance may also be performed easily in the axial direction.

The adjustment is performed especially easily due to the fact that the half shells are screwed together and the bolts are readily accessible from the outside, preferably from underneath.

To achieve a great clamping force, it is also advantageous when working with large tolerances for the half shells of each pair to have at least three elevations distributed over the two half shells to create a three-point clamping.

Especially good results are also achieved due to the fact that each half shell of each pair has at least two elevations to create a four-point clamping.

The stripper teeth are preferably forged and are provided with wear-proof caps on their ends.

BRIEF DESCRIPTION OF THE DRAWINGS

This invention is explained in greater detail below on the basis of an exemplary embodiment which is illustrated in the drawings, which show schematically.

DETAILED DESCRIPTION OF THE INVENTION

Figure 1:
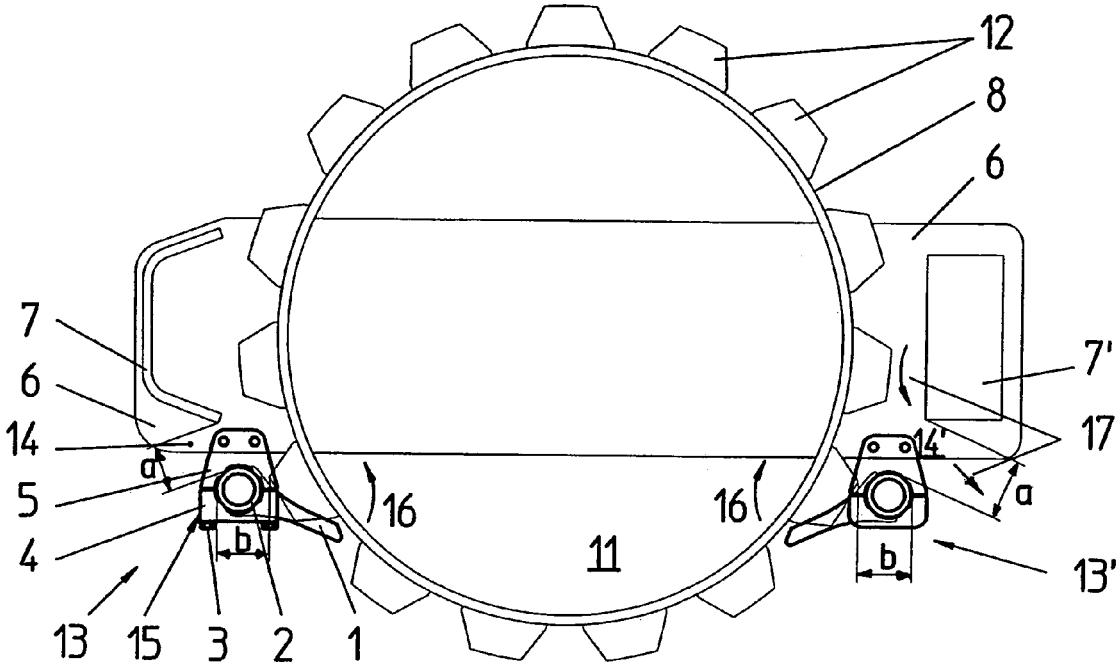
FIG. 1 a cross section through a soil compacting roller having tamping feet.

FIG. 1 illustrates a soil compacting roller 11 cut across its axis and having tamping feet 12 distributed over the binding wire 8. The soil compacting roller 11 is arranged in a frame of two cheeks 6, only one of which is visible in the diagram, and two axially parallel crossbars 7, 7'.

For cleaning the binding wire 8 and the interspaces, two stripping devices 13, 13' are provided between the tamping feet 12 in the example illustrated here, each stripping device running parallel to and beneath the crossbars 7, 7', forming a gap 14, 14'. As also shown in the enlarged diagrams according to FIG. 2, FIG. 3 and FIG. 4, the stripping devices 13, 13' each have a spar designed as a pipe 2 having a circular cross section to function as the support for solid forged stripper teeth 1 which protrude radially into the interspaces between the tamping feet 12, directed obliquely downward in the condition depicted in FIG. 1.

Figure 2:
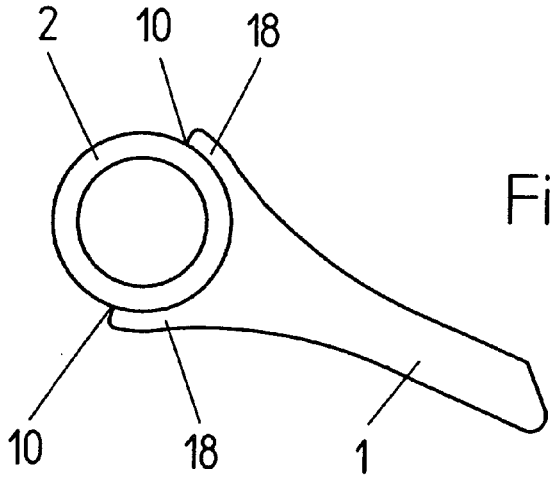
FIG. 2 a detail of soil compacting roller according to FIG. 1 in an enlarged diagram.
Figure 3:
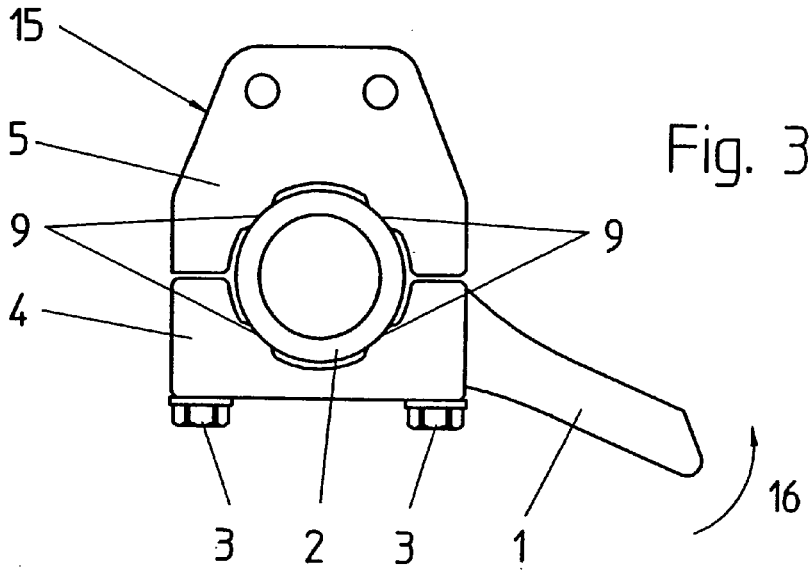
FIG. 3 a detail of the soil compacting roller according to FIG. 1 in an enlarged diagram.

As illustrated by the cross section of the spar situated between the spar mounts 15 shown in FIG. 2, each tooth 1 has, in its support area and base, two fingers 18 which extend around the pipe 2 in the area of a circular segment of approximately 180°. The fingers 18 are welded to the pipe 2 along welds 10, which are situated symmetrically and diametrically opposed by an angle offset of approximately 180°.

The pipe 2 is detachably mounted on both ends in an optionally adjustable spar mount 15 which permits readjustment of the stripper teeth 1 on the soil compacting roller 11 by swiveling the pipe 2 in the direction of arrow 16. The pivot axis is parallel to the axis of the soil compacting roller 11 at the center of gravity of the carrier profile. The spar mounts 15 are mounted on the cheeks 6 by screw connections, for example.

The pipes 2 are arranged at a minimal distance from the binding wire 8 so that they do not increase the overall length of the frame. Furthermore, they run parallel to the crossbars 7, 7' with a sufficiently large gap width a, so that stripped soil material will reliably fall through and be diverted away, e.g., according to arrow 17. The pipe diameter and the base areas of the stripper teeth 1 have a small diameter and thus form a relatively small area with an effective width b so that if necessary only a small amount of soil material can be deposited there.

The spar mounts 15 each have two half shells 4, 5 which encompass the pipe 2 and are detachably connected by screws 3 to form a clamp connection. Two elevations 9 offset by 90°, for example, are provided on the inside surfaces of each half shell 4, 5 so that good four-point clamping is achieved. When the screws 3 are tightened, the pipe 2 is clamped in a rotationally fixed and displacement fixed manner. Thus the position and the alignment of the stripper teeth 1 are fixed. If the bolts 3 are loosened, the pipe 2 can be pivoted for radial and axial readjustment of the stripper teeth 1 and can be shifted axially. This adjustment is simple to perform because the screws 3 are readily accessible from beneath.

Figure 4:
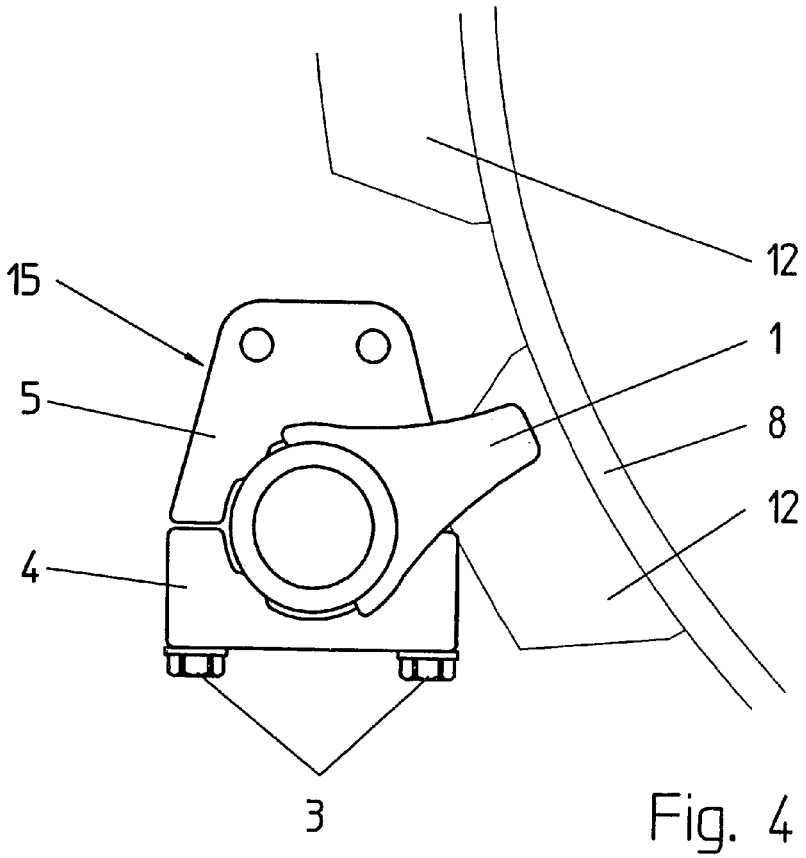
FIG. 4 a detail of the soil compacting roller according to FIG. 1 in an advanced state of wear.

In the event of wear on the stripper teeth 1 according to FIG. 4, the teeth are readjusted by swiveling the pipe 2 toward the binding wire 8, with a long adjustment path being the result of the swivel principle. The wear can be compensated except for a tooth length, which corresponds to the distance of the pipe 2 from the binding wire 8 without having any negative effect on the stripper function. This maximal adjustment is illustrated in FIG. 4.

The invention claimed is:

1. A scraping device for a soil compacting roller with tamping feet, with a cross member on which scraper teeth are arranged, and with a selectively adjustable cross member holder, which makes it possible to readjust the scraper teeth on the soil compacting roller, characterized in that the cross member exhibits a tube and that at least one end of the cross member holder exhibits a pair of half shells, which at least partially envelop the tube and are connected so as to be detachable, for the purpose of clamping the tube so as not to rotate or slide, wherein the half shells of each pair exhibit at least three protuberances, distributed over both half shells, for the purpose of producing at least a three point clamping arrangement.

2. The scraping device, as claimed in claim 1, characterized in that the cross member exhibits a tube with a circular cross section.

3. The scraping device of claim 1, characterized in that each end of the tube exhibits a pair of half shells for the purpose of clamping the tube so as to be detachable as well as nonrotational and immovable.

4. The scraping of claim 1, characterized in that the half shells of each pair are connected with screws, which are freely accessible for loosening and tightening.

5. The scraping device, as claimed in claim 1, characterized in that the teeth are forged.

6. The scraping device, as claimed in claim 1, characterized in that the ends of the teeth are provided with wear caps.

7. The scraping device according to claim 1, comprising a two crossbars, characterized in that in the original state the teeth are longer than the distance between the cross member and a roller tire, when the cross member is mounted on a soil compacting roller.

8. The scraping device according to claim 1, comprising a two crossbars, characterized in that the cross member is arranged below the crossbars and at a distance from it so as to form an ejection and that the scraper teeth point away from the crossbars.

9. The scraping device as claimed in claim 1, characterized in that the bearing areas of the scraper teeth exhibit two fingers, which envelop the cross member in the area of a circular segment, and the fingers are welded to the tube.

10. The scraping device, as claimed in claim 9, characterized in that the fingers are welded next to each other on the tube so that their angle is symmetrically offset, preferably diametrically below 180°.

11. A scraping device for a soil compacting roller with tamping feet, with a cross member on which scraper teeth are arranged, and with a selectively adjustable cross member holder, which makes it possible to readjust the scraper teeth on the soil compacting roller, characterized in that the cross member exhibits a tube and that at least one end of the cross member holder exhibits a pair of half shells, which at least partially envelop the tube and are connected so as to be detachable, for the purpose of clamping the tube so as not to rotate or slide, wherein each half shell of each pair exhibits to two protuberances for the purpose of producing a four-point clamping.

12. The scraping device, as claimed in claim 11, characterized in that each end of the tube exhibits a pair of half shells for the purpose of clamping the tube so as to be detachable as well as nonrotational and immovable.

13. The scraping device, as claimed in claim 11, characterized in that the cross member exhibits a tube with a circular cross section.

14. The scraping device as claimed in claim 13, characterized in that the bearing areas of the scraper teeth exhibit two fingers, which envelop the cross member in the area of a circular segment, and the fingers are welded to the tube.

15. The scraping device, as claimed in claim 14, characterized in that the fingers are welded next to each other on the tube so that their angle is symmetrically offset, preferably diametrically below 180°.

* * * * *

UNITED STATES PATENT AND TRADEMARK OFFICE

CERTIFICATE OF CORRECTION

PATENT NO. : 7,044,683 B2
APPLICATION NO. : 10/954480
DATED : May 16, 2006
INVENTOR(S) : Christian Berg It is certified that error appears in the above-identified patent and that said Letters Patent is hereby corrected as shown below:

Column 4
Line 22, please insert --device-- after “scraping”.

Signed and Sealed this

Twenty-fifth Day of July, 2006

JON W. DUDAS
*Director of the United States Patent and Trademark Office*